US006993868B2

(12) United States Patent
Hronyetz

(10) Patent No.: US 6,993,868 B2
(45) Date of Patent: Feb. 7, 2006

(54) ADJUSTABLE TREE STAND

(76) Inventor: Albert L. Hronyetz, 3632 Milligantown Rd., New Kensington, PA (US) 15068

( * ) Notice: Subject to any disclaimer, the term of this patent is extended or adjusted under 35 U.S.C. 154(b) by 0 days.

(21) Appl. No.: 10/847,228

(22) Filed: May 18, 2004

(65) Prior Publication Data

US 2005/0257422 A1 Nov. 24, 2005

(51) Int. Cl.
*A47G 33/12* (2006.01)

(52) U.S. Cl. ..... 47/40.5; 248/514; 248/516; 248/517; 248/515; 248/519; 248/523

(58) Field of Classification Search ..... 248/514–517, 248/519, 523; 47/40.5; D11/130.1; A47G 33/12
See application file for complete search history.

(56) References Cited

U.S. PATENT DOCUMENTS

| | | | | |
|---|---|---|---|---|
| 913,474 A | | 2/1909 | Dreibuss | |
| 1,644,807 A | * | 10/1927 | Zeigler | 248/526 |
| 2,617,617 A | * | 11/1952 | Krastel et al. | 47/40.5 |
| 2,812,916 A | | 11/1957 | Jonasson et al. | 248/44 |
| 3,298,642 A | | 1/1967 | Taylor | 248/44 |
| 3,298,643 A | | 1/1967 | Taylor | 248/44 |
| 4,034,505 A | | 7/1977 | Lydall | 47/40.5 |
| 4,408,415 A | | 10/1983 | Davis et al. | 47/40.5 |
| 4,429,846 A | | 2/1984 | Halvorson | 248/524 |
| 4,477,049 A | | 10/1984 | Davis | 248/524 |
| 4,571,882 A | | 2/1986 | Capen | 47/40.5 |
| 4,712,328 A | | 12/1987 | Gies | 47/40.5 |
| 4,891,905 A | * | 1/1990 | Stolz | 47/65.8 |
| 4,901,971 A | | 2/1990 | Connelly | 248/523 |
| 4,913,395 A | | 4/1990 | Juhas | 248/516 |
| 4,936,538 A | | 6/1990 | Royce | 348/524 |
| 4,967,508 A | | 11/1990 | Reynolds | 47/40.5 |
| 4,978,098 A | | 12/1990 | Peckinpaugh | 248/523 |
| 5,014,461 A | | 5/1991 | Vom Braucke et al. | 47/40.5 |
| 5,114,113 A | | 5/1992 | Krinner | 248/525 |
| 5,137,246 A | | 8/1992 | Idso | 248/523 |
| 5,249,772 A | | 10/1993 | Montie, Jr. et al. | 248/523 |
| 5,301,462 A | | 4/1994 | Hronyetz | 47/40.5 |
| 5,375,807 A | | 12/1994 | Claas | 248/514 |
| 5,393,031 A | * | 2/1995 | Leve | 248/516 |
| 5,398,444 A | * | 3/1995 | Murray | 47/40.5 |
| 5,465,529 A | | 11/1995 | Park | 47/40.5 |
| 5,478,042 A | | 12/1995 | Bliss et al. | 248/523 |
| 5,492,301 A | | 2/1996 | Hauser | 248/516 |
| 5,605,315 A | | 2/1997 | Hartung et al. | 248/523 |
| 5,707,037 A | * | 1/1998 | Pastrick | 248/516 |
| 5,797,579 A | | 8/1998 | Krinner | 248/52.3 |
| 5,797,580 A | | 8/1998 | Ryberg | 248/523 |
| 5,845,890 A | * | 12/1998 | Earsley et al. | 248/516 |

(Continued)

FOREIGN PATENT DOCUMENTS

DE 3421733 A1 * 12/1985

(Continued)

*Primary Examiner*—Peter M. Poon
*Assistant Examiner*—Andrea M. Valenti
(74) *Attorney, Agent, or Firm*—Andrew Alexander

(57) ABSTRACT

An adjustable tree stand for holding a tree trunk to position a tree in a substantially vertical position, the tree stand comprised of a generally cylindrical-shaped base member having a top end and a bottom end, the bottom end adapted to be supported by a floor, a generally dish-shaped member is designed to be received by and supported by the top end of the cylindrical base member, a portion of the dish-shaped member is adapted to swivel in the top end of the cylindrical member.

6 Claims, 4 Drawing Sheets

U.S. PATENT DOCUMENTS

| | | | | |
|---|---|---|---|---|
| 5,870,858 | A | 2/1999 | Manuel | 47/40.5 |
| 6,010,108 | A * | 1/2000 | Welzen | 248/527 |
| 6,019,341 | A * | 2/2000 | Brown et al. | 248/516 |
| 6,094,859 | A * | 8/2000 | Kalman et al. | 47/40.5 |
| 6,155,529 | A | 12/2000 | De Carlo | 248/523 |
| 6,367,195 | B1 | 4/2002 | Heyworth | 47/40.5 |
| 6,419,200 | B1 * | 7/2002 | Tuneld et al. | 248/514 |
| 6,572,064 | B1 | 6/2003 | Letson et al. | 248/349.1 |
| 6,681,519 | B2 | 1/2004 | Cone | 47/40.5 |

FOREIGN PATENT DOCUMENTS

| | | | |
|---|---|---|---|
| DE | 301601 | A1 * | 7/1987 |
| DE | 19934781 | A1 * | 1/2001 |
| DK | 9901755 | A * | 12/1999 |
| EP | 943273 | A * | 3/1998 |

* cited by examiner

ADJUSTABLE TREE STAND

BACKGROUND OF THE INVENTION

This invention relates to a tree stand for cut trees such as Christmas trees, and more particularly it relates to an adjustable tree stand which permits trees to be mounted vertically even when the tree has a bent trunk.

The art is replete with tree stands for cut trees. However, such stands usually have too many working parts and are difficult to use. For example, U.S. Pat. No. 5,577,701 discloses 1 tree stand includes a bowl 12 with a backpost 14 fastened therein. The backpost includes a set of jaws or teeth 40*u* which bear against the tree trunk. A set of upper and lower straps 60*u* and 60*l* is buckled to the backpost in a manner which allows the length to be changed. An over-center clamp lever 64*u*, 64*l* is associated with the upper and lower straps, for tensioning the straps against the tree trunk. A set of standoffs 50 is interposed between the straps and the tree trunk at locations opposite to the jaws of the backpost. The tree stand bowl 12 has a spherical shape, which mates with a spherical bowl receptacle or base 32, allowing the bowl to be rotated or tilted relative to the bowl receptacle, to align the tree. A set of edge fasteners clamps the edges of the bowl to the bowl receptacle at the selected position.

U.S. Pat. No. 5,114,113 discloses a Christmas-tree stand (2) features a foot-piece (4) with a connected holder (6) to which fastening components (14, 16, 18 and 20) are attached. In the example case, these components are swinging clamps which are pressed against the outer surface of the tree trunk by a clamping device (46). The pressure of the clamping device (46) is applied to the fastening components (14, 16, 18 and 20) via a steel cable (66), for example, which encircles them and is attached to the clamping device (46). The cable (66) moves the fastening components (14, 16, 18 and 20) toward the trunk with adjustable and evenly distributed force.

U.S. Pat. No. 5,492,301 discloses a Christmas tree stand which is characterized by a base for resting on a supporting surface, a ball assembly swivally secured to the base in universally-pivoting relationship by means of a fixed socket bracket and a cooperating movable socket bracket and a mount cup secured to the ball assembly for receiving and mounting the trunk of a Christmas tree. The mount cup and ball assembly are designed to pivot and swivel in a 360-degree rotation to orient the tree in a vertical position regardless of the configuration of the trunk. In a preferred embodiment accessory leg extensions are adjustably slidably extendable from the base for further stabilizing the Christmas tree stand.

U.S. Pat. No. 5,465,529 discloses outdoor or indoor stand for supporting decorative trees, such as Christmas trees. In this stand, the bottom of a tree trunk is inserted into a cylindrical support vessel medially and orthogonally mounted on the top surface of a base plate. The lower and upper portions of the tree trunk are held by first and second abutment portions. Each of the first and second abutment portions and a support arm portion comprises three members that are separately produced but assembled into and handled in a unit. The stand prevents possible sway of the tree such as due to outside impact, firmly supports any thickness of tree trunk and achieves easiness to handle.

U.S. Pat. No. 5,797,580 discloses a stand for supporting a cut tree trunk in a vertical position includes a tree trunk encircling clamp, having a first curvate locking jaw and a second curvate locking jaw each having a free end and a base end. The base ends are pivotally connected to each other at a base. The locking jaws include a serrated inner surface convexly curved in a radially inward direction facing each other for closure with a tree trunk. A locking clamp includes a rigid handle fixedly secured to the base end of the first locking jaw and a pivoting handle pivotally secured to the second pivoted jaw adjacent the base end of the rigid handle. The pivoting handle extends radially outwardly to respective distal free ends of the first and second curvate locking jaws. An adjustable locking shaft is threadedly mounted within the rigid handle and extends radially inwardly thereof. A pair of elongated locking toggles are pivoted at a respective inner pivot end in the first curvate locking jaw and in the pivoting handle. Each locking toggle includes a free end extending radially outwardly and engaging the locking shaft within the locking handle. A plurality of support legs extend peripherally downwardly from the locking clamp. Each leg includes a floor engaging free end supported upon a threaded leveling shaft with a foot pad assembly.

U.S. Pat. No. 5,249,772 discloses a stand for a Christmas tree which includes an inner portion which is securable to the trunk portion of a Christmas tree and a base portion which is adapted for receiving the inner portion and the trunk portion therein in order to support the Christmas tree in a substantially upright disposition on a supporting surface. The stand further includes a centering assembly for centering the inner portion and the bottom end of the trunk portion of the Christmas tree relative to the base portion and a plurality of securing arms on the inner portion which are engageable with the base portion for adjustably securing the angular position of the Christmas tree relative to the stand.

U.S. Pat. No. 4,901,971 discloses a Christmas tree stand which includes a flat-bottomed, water-tight canister supported by adjustable legs mounted thereon, the adjustability feature accommodating uneven surfaces and crooked tree trunks. The interior of the canister has a transverse pentagonal shape, open at the top and bounded by side walls, a rear wall and a pair of convergent front walls, the latter forming an angled juncture. A screw crank extends through the rear wall transversely centered in, and above the middle thereof, opposite said juncture. The screw crank urges a rectangular free-floating push plate positioned in the canister's interior against the trunk of a Christmas tree positioned in the interior between the junction and the push plate. Rotation of the screw crank advances the screw end of the crank, applying pressure against the push plate, and through the latter against the tree, thereby positioning and securing the tree in the stand.

U.S. Pat. No. 5,137,246 discloses a stand for Christmas trees comprised of a base plate with a pair of spaced-apart upright brackets mounted thereon. The tree holder receptacle is pivotally mounted between the upright brackets so that is can move about a horizontal axis in order to orient the tree trunk to a generally vertical position. A pair of locking levers are associated with the upright brackets so that they can be releasably clamped to orient the tree holder receptacle in any desired position. A set screw is provided to accept the tree into the tree holder receptacle.

U.S. Pat. No. 913,474 discloses in a tree or staff holder, the combination of a three legged base having three upright curved arms, each arm having a recessed top end; and the base having a dowel pin at its center; a ring fitting and rotating in the top recessed ends of the upright arms of the base, having a square opening in its center; a square tapered can fitting into the ring and having a hollow bottom, which bottom fits and rotates about the dowel pin at the center of the base, and the can capable of holding a liquid; and four marbles, one of the marbles in each of the four edges of the can.

U.S. Pat. No. 5,301,462 discloses stands for cut trees, such as Christmas trees, and more particularly, it relates to a tree stand which permits the tree to be mounted vertically even when the tree trunk is bent.

U.S. Pat. No. 4,034,505 discloses a stand for an elongate upright object, such as a tree, including a fluid-holding receptacle into which the butt, or base, end of the object may be received, with a restraining device for engaging and holding the butt of the object against lateral movement in the receptacle. A cover for the receptacle has an opening extending therethrough to receive a portion of the object with screw adjustable engaging members mounted on one side of the opening. An elongate serrated wedge is slidably mounted on the top of the cover opposite the engaging members. The wedge may be slid into position frictionally engaging the object to hold it in place against the engaging members. Another opening in the cover is so positioned and of such size as to receive a support for the wedge on another cover to accommodate nested stacking of a plurality of the covers. A fluid barrier is removably mounted in the receptacle to prevent fluid in the receptacle from contacting the base of the object if desired.

U.S. Pat. No. 4,477,049 discloses a tree holder bar and an inverted U-shaped support bar are welded at their lower ends to a circular base ring, leaving an open space to receive a water container. Upper portions of the two bars are welded together adjacent a downward bend in the tree holder bar, the lower extremity of which has an upturned point to be driven into the trunk of the tree. A V-shaped bracket adjacent the bend in the tree holder bar receives a pair of nails to be driven into the sides of the tree trunk. The tree holder bar is bendable to make the tree stand straight.

Other tree stands are disclosed in U.S. Pat. Nos. 2,812,916; 3,298,642; 3,298,643; 4,408,415; 4,429,846; 4,571,882; 4,712,328; 4,913,395; 4,936,538; 4,967,508; 4,978,098; 5,014,461; 5,375,807; 5,478,042; 5,605,315; 5,797,579; 5,870,858; 6,155,529; 6,367,195; 6,572,064; and 6,681,519.

In spite of these disclosures, there is still a great need for a simplified adjustable tree stand which can be used for providing a source of water to keep the tree fresh.

SUMMARY OF THE INVENTION

It is an object of the invention to provide an improved tree stand.

It is another object of the invention to provide an adjustable tree stand having a water reservoir.

It is yet another object of the invention to provide an adjustable tree stand having a trunk holder which permits ease of mounting the tree in the vertical position.

These and other objects will become apparent from the description, claims and drawings appended hereto.

In accordance with these objects, there is disclosed an adjustable tree stand for holding a tree trunk to position a tree in a substantially vertical position, the tree stand comprised of a generally cylindrical-shaped base member having a top end and a bottom end, the bottom end adapted to be supported by a floor. The tree stand further comprises a generally dish-shaped member designed to be received by and supported by the top end of the cylindrical base member. A portion of the dish-shaped member is adapted to swivel or rotate in the top end of the cylindrical member. Means is provided in the dish member to clamp the tree trunk thereto; and means is provided to clamp or secure the dish member to the cylindrical member after the trunk has been swiveled on the cylindrical end to a generally vertical position.

DETAILED DESCRIPTION OF PREFERRED EMBODIMENTS

Figure 1:
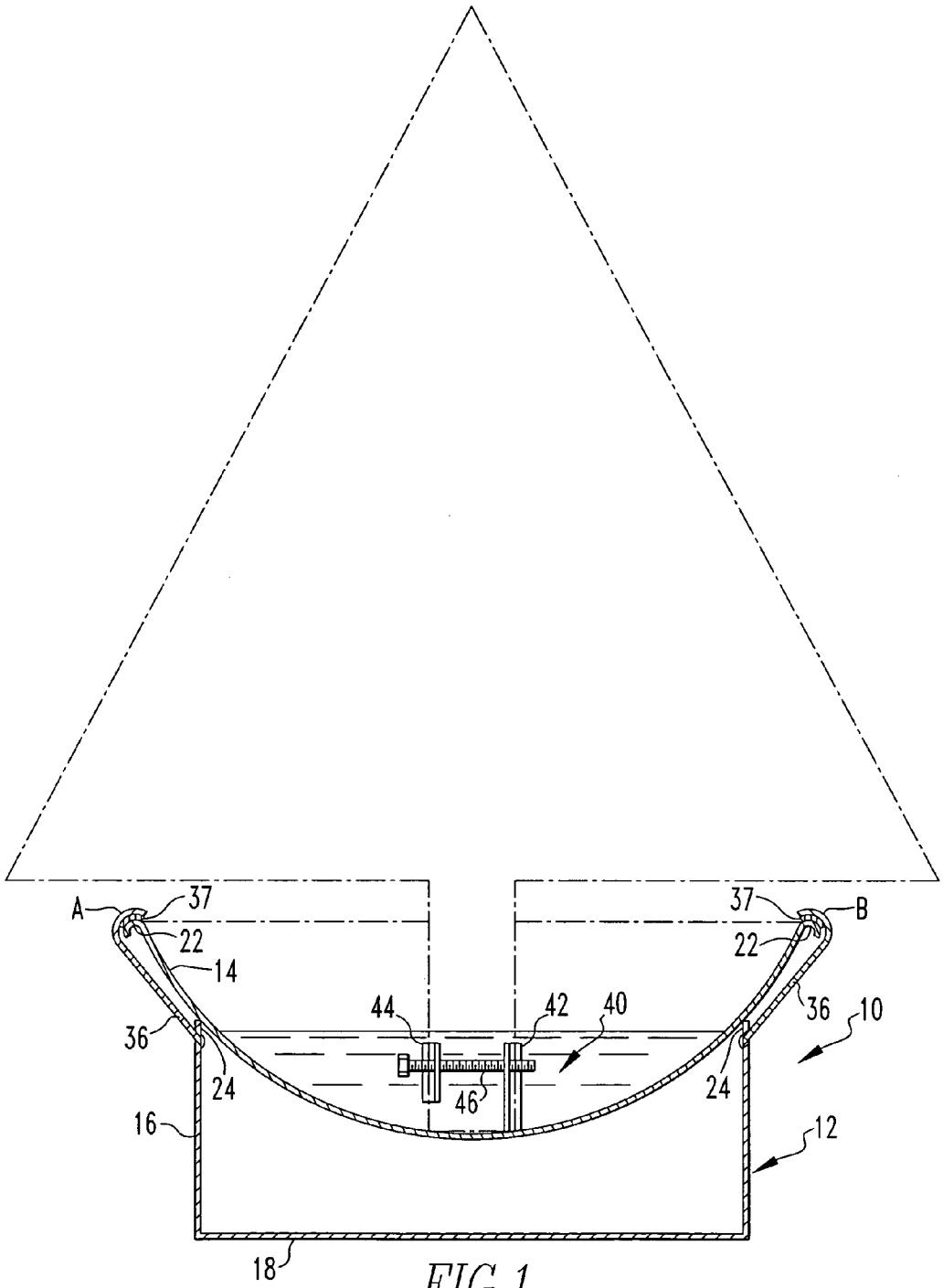
FIG. 1 is a sectional view of the tree stand showing a tree positioned in the tree stand.

FIG. 1 is a cross-sectional view of a tree stand 10 showing a base 12 and an adjustable tree trunk holder 14 resting or supported by base 12. Base 12 preferably is cylindrical in shape having a cylindrical side 16 and bottom 18. Bottom 18 makes for ease of moving or sliding the stand over carpeting or similar material, otherwise the bottom is not required. For a six- to ten-feet tree height, the stand typically would require about a 18-inch diameter base to provide for stability. Base 12 supports a bowl or dish-shaped member 14. Thus, it will be appreciated that bowl or dish-shaped member 14 has a diameter or measurement from lip or point A to point B which is larger than the diameter of the cylindrical portion of the base.

Bowl or dish-shaped member 14 utilizes a lip 22 which is designed to engage top 24 (see FIG. 3) of cylindrical side 16. This engagement of occurs when bowl 14 is rotated or swiveled to accommodate a bent or crooked tree trunk (see FIG. 2). Thus, lip 22 prevents bowl 14 from rotating beyond the point where it would be unstable. Accordingly, lip 22 acts as a stop. While the stop is shown as lip 22, it will be appreciated that any stop may be used which prevents bowl 14 from rotating beyond the point where the stand becomes unstable.

Figure 2:
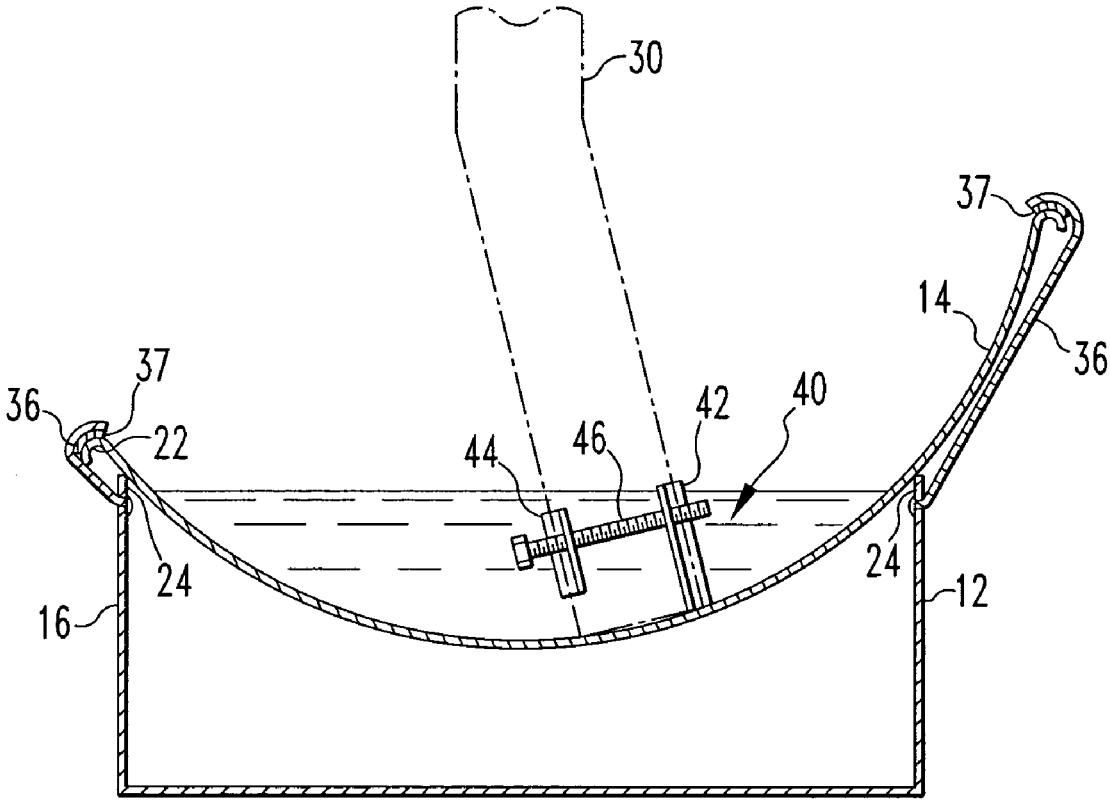
FIG. 2 is a cross-sectional view of a tree stand illustrating a twisted or bent tree trunk and the stand adjustment to provide a vertical tree.

In FIG. 2, bowl 14 is shown rotated to permit lip 22 to almost engage top 24 of cylinder side 16. It will be seen that tree trunk 30 mounted in bowl 14, even though not straight, extends substantially vertically when the bowl is rotated as shown. Also, it will be understood that FIG. 2 is merely illustrative, and the bowl is not required to be rotated to the extent where it is connected with lip 22. That is, if the bend in the tree trunk is not severe, it may only require a small adjustment to make the tree vertical.

To secure the bowl in the adjusted position, straps 36 may be used to secure the bowl to the base. The straps may be comprised of Velcro or some such material which provides for ease of fastening and unfastening and yet does not interfere with swiveling or rotating action of bowl 14. A second strip 37 of Velcro is provided around lip 22 for purposes of fastening straps 36 thereto when the bowl is in the adjusted position. Further, four straps have been found sufficient to securely attach bowl 14 to base 12. The straps are shown in FIGS. 1, 2 and 3.

Figure 3:
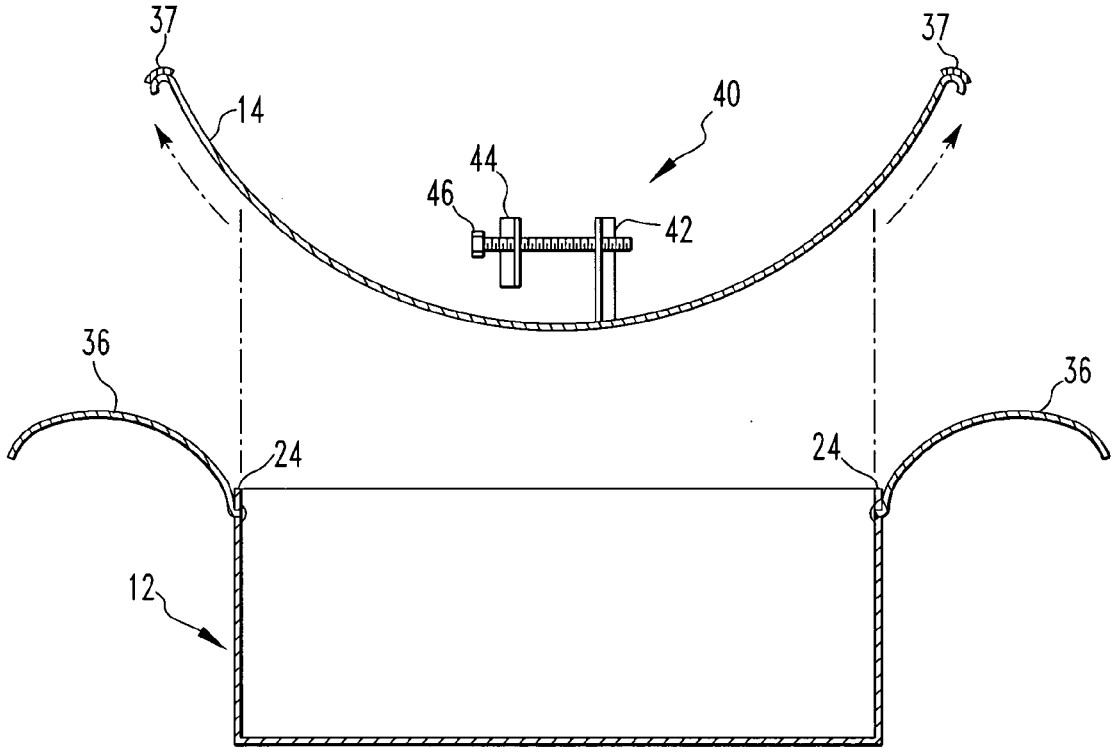
FIG. 3 is an exploded view of the base and tree holder.

FIG. 3 shows an exploded view of base 12 and bowl 14. Also, straps 36 are shown in FIG. 3 unattached to bowl 14. The arrows shown in FIG. 3 below bowl 14 illustrate that the bowl can be rotated on base 12 to the desired location.

Figure 4:
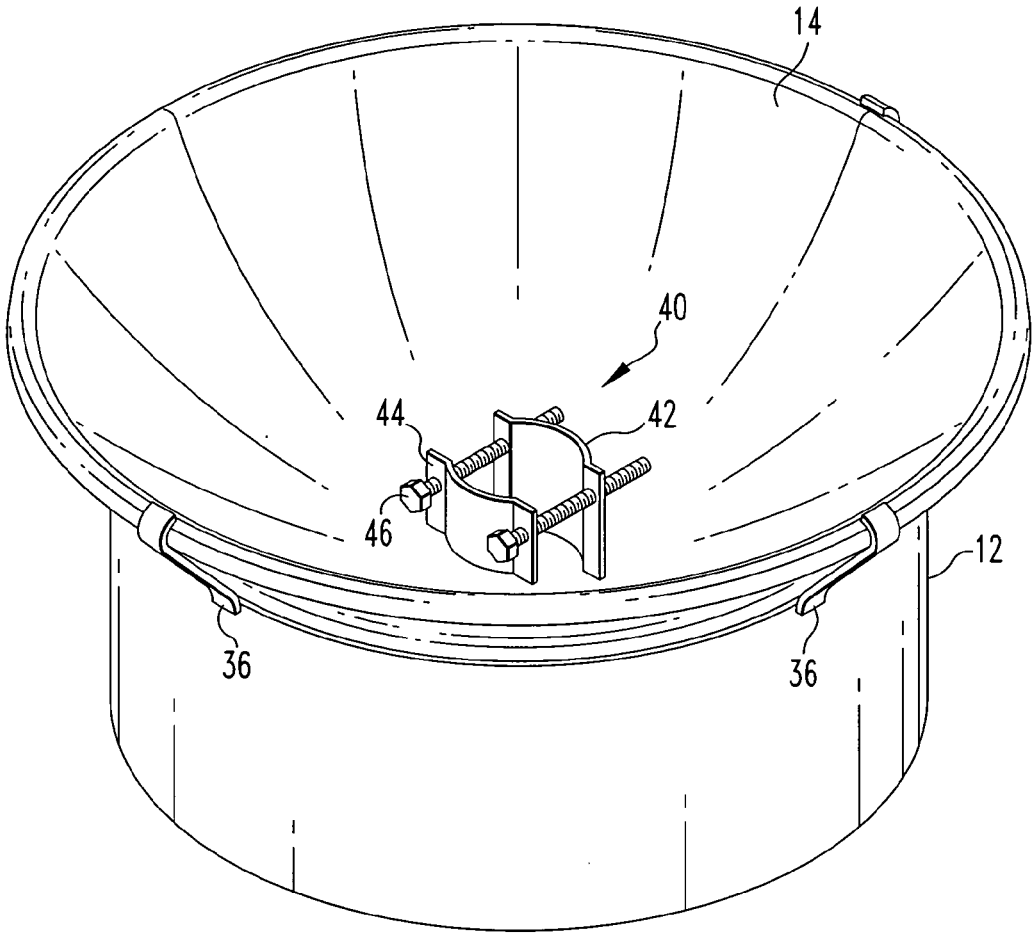
FIG. 4 is a perspective view of the adjustable tree stand.

FIG. 4 is a perspective view showing the bowl-shaped tree-trunk holder 14 positioned on base 12. In the center of tree-trunk holder 14 is located a collar 40 for securely clamping tree-trunk 30 to bowl 14. Collar 40 is comprised of a stationary member 42 and a second member 44 connected to stationary member 42 using two threaded connectors 46 which screw into stationary member 42.

Figure 5:
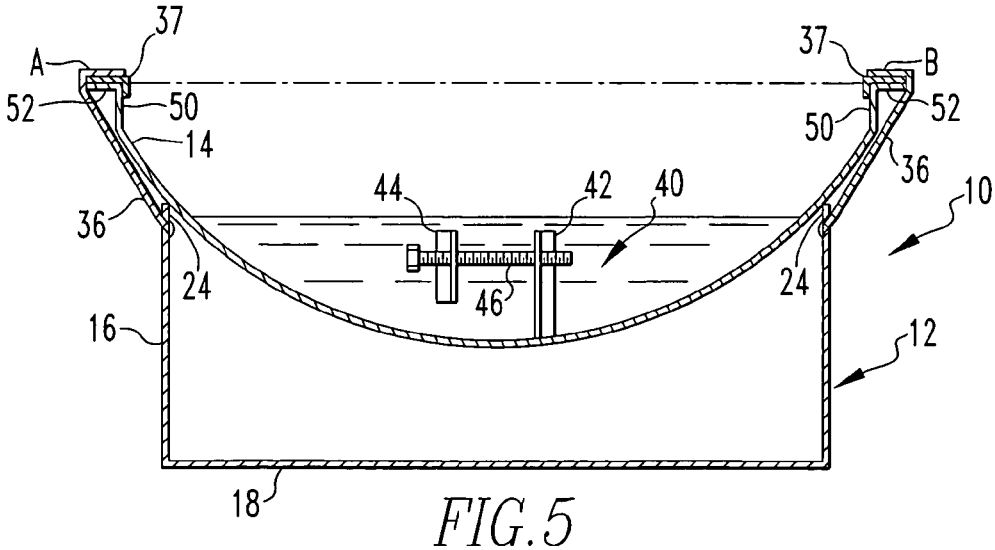
FIG. 5 is a cross-sectional view of another eembodiment of the invention.

FIG. 5 is a cross-sectional view of another embodiment of the invention. In FIG. 5, bowl 14 is provided with a substantially cylindrical section 50 extending upwardly from bowl 14. Further, a lip 52 is provided extending generally radially outwardly from cylindrical section 50, as shown in FIG. 5. A strip of Velcro 37 is provided on lip 52 and can be extended onto cylindrical section 50, as shown in FIG. 5. Straps 36 can then be fastened to strip 37 to secure bowl 14 to base 12.

In using the tree stand, bowl 14 may be removed and while the tree is on its side, bowl 14 can be clamped onto trunk 30. Thereafter, the bowl is placed on base 12 and moved or adjusted thereon until the tree is vertical. Then, the bowl is fastened to the base using straps 36. Bowl 14 has the advantage that it can be used to contain water to maintain the tree in a fresh condition.

The stand may be fabricated from metal or plastic or like materials.

Having described the presently preferred embodiments, it is to be understood that the invention may be otherwise embodied within the scope of the appended claims.

What is claimed is:

1. An adjustable tree stand for holding a tree trunk to position a tree in a substantially vertical position, the tree stand comprised of:

(a) a cylindrical-shaped base member having vertical sides and having an open top end and a bottom end, the bottom end supported by a floor;

(b) a dish-shaped member designed to be received by and directly supported by said top end of said cylindrical base member, a portion of said dish-shaped member swivels in said top end of said cylindrical member, said dish-shaped member having a diameter greater than the diameter of said cylinder-shaped member;

(c) fastening means provided in said dish member for clamping said tree trunk thereto; and (d) fastening means provided for clamping said dish member to said cylinder-shaped member after said trunk has been swiveled on said open top end to a generally vertical position.

2. The tree stand in accordance with claim 1 wherein said dish member is designed to contain water to maintain said tree in a fresh condition.

3. The tree stand in accordance with claim 1 wherein said dish member has a lip extending outward therefrom to engage a wall of the cylindrical member and limit the amount of swivel by said dish member.

4. An adjustable tree stand for holding a tree trunk to position a tree in a substantially vertical position, the tree stand comprised of:

(a) a cylindrical-shaped base member having vertical sides and having an open top end and a bottom end, the bottom end supported by a floor;

(b) a bowl-shaped member designed to be directly supported by said open top end of said cylindrical base member, the bowl-shaped member rotates on said top end of said cylindrical portion, said bowl-shaped member having a diameter greater than the diameter of said cylinder-shaped member;

(c) means provided in said bowl member for clamping said tree trunk thereto; and (d) means provided for clamping said bowl member to said cylinder-shaped member after said trunk has been swiveled on said open end to a generally vertical position.

5. The tree stand in accordance with claim 4 wherein said bowl member is designed to contain water to maintain said tree in a fresh condition.

6. The tree stand in accordance with claim 4 wherein said bowl member has a lip extending outward therefrom to engage a wall of the cylinder-shaped member and limit the amount of swivel by said bowl member.

* * * * *